US009644585B2

(12) United States Patent
Lucas

(10) Patent No.: US 9,644,585 B2
(45) Date of Patent: May 9, 2017

(54) AUXILIARY PRESSURE RELIEF VALVE IN SINGLE PISTON FUEL PUMP

(71) Applicant: Stanadyne Corporation, Windsor, CT (US)

(72) Inventor: Robert G. Lucas, Ellington, CT (US)

(73) Assignee: Stanadyne LLC, Windsor, CT (US)

( * ) Notice: Subject to any disclaimer, the term of this patent is extended or adjusted under 35 U.S.C. 154(b) by 224 days.

(21) Appl. No.: 14/358,788

(22) PCT Filed: Nov. 14, 2012

(86) PCT No.: PCT/US2012/064963
§ 371 (c)(1),
(2) Date: May 16, 2014

(87) PCT Pub. No.: WO2013/074592
PCT Pub. Date: May 23, 2013

(65) Prior Publication Data

US 2014/0305410 A1 Oct. 16, 2014

Related U.S. Application Data

(60) Provisional application No. 61/629,377, filed on Nov. 17, 2011.

(51) Int. Cl.
*F02M 37/04* (2006.01)
*F02M 69/46* (2006.01)
(Continued)

(52) U.S. Cl.
CPC ..... *F02M 41/00* (2013.01); *F02M 59/367* (2013.01); *F02M 59/464* (2013.01); *F02M 63/0235* (2013.01); *F02M 63/0245* (2013.01)

(58) Field of Classification Search
CPC ..... F02M 59/366; F02M 63/0225; F02M 57/025; F02M 59/105; F02M 59/102; B60T 8/4031; F04B 1/0404; F02B 3/06
(Continued)

(56) References Cited

U.S. PATENT DOCUMENTS 6,135,090 A * 10/2000 Kawachi ..... F02D 41/3809 123/446
7,377,753 B2 * 5/2008 Kuroda ..... F02M 53/00 417/251
(Continued)

FOREIGN PATENT DOCUMENTS

EP 1 411 238 A1 4/2004
JP 2009257197 11/2009

*Primary Examiner* — Carlos A Rivera
*Assistant Examiner* — Syed O Hasan
(74) *Attorney, Agent, or Firm* — Alix, Yale & Ristas, LLP

(57) ABSTRACT

A fuel pump has a low pressure fuel inlet (40) and a single piston pumping chamber (10) for supplying high pressure fuel through a pump outlet to an inlet side of a common rail (16). The fuel pump comprises a primary pressure relief valve (12) having an inlet side in hydraulic communication with the inlet side of the common rail (16) and an outlet side in fluid communication with the pumping chamber (10); and an auxiliary pressure relief valve (19) having an inlet side (35) in hydraulic communication with the pumping chamber (10) and an outlet side in direct fluid communication with a fuel passage (37) at the low pressure of the pump inlet (40).

14 Claims, 6 Drawing Sheets

(51) Int. Cl.

| | |
|---|---|
| ***F02M 57/02*** | (2006.01) |
| ***F04B 19/00*** | (2006.01) |
| ***F02M 41/00*** | (2006.01) |
| ***F02M 59/36*** | (2006.01) |
| ***F02M 59/46*** | (2006.01) |
| ***F02M 63/02*** | (2006.01) |

(58) Field of Classification Search
USPC ..... 123/456, 446, 505, 506; 417/251, 383, 417/470
See application file for complete search history.

(56) References Cited

U.S. PATENT DOCUMENTS

| | | | | |
|---|---|---|---|---|
| 2004/0109768 | A1* | 6/2004 | Sommars | F02M 59/08 417/307 |
| 2011/0126804 | A1* | 6/2011 | Lucas | F02M 59/366 123/456 |

* cited by examiner

AUXILIARY PRESSURE RELIEF VALVE IN SINGLE PISTON FUEL PUMP

BACKGROUND

The present invention relates to single piston, cam driven high pressure fuel pumps for generating high pressure fuel in common rail direct injection gasoline engines.

It is known in the industry that the pump must incorporate an outlet check valve to prevent pressure bleed back from the rail while the pump is in the intake stroke cycle. It has become an industry requirement to incorporate a pressure relief valve within the pump to protect the entire high pressure system from an unexpected excess pressure caused by a system malfunction. In order to protect the rail and injectors, the pressure relief valve must be in hydraulic communication with the rail, i.e., in parallel with the pump flow. Two such executions are described in U.S. Pat. Nos. 7,401,593 and 8,132,558.

The executions described in the prior art are successful in their ability to achieve a reasonable relief pressure by hydraulically disabling the relief device during the pumping event when normal high pressure line pulsations occur. However, in high output pump applications there are some significant limitations. Firstly, the necessary increased flow rate and required upsizing of the relief valve device becomes prohibitive in packaging within a modern single piston pump. Secondly, the added flow rate into the low pressure side of the pump by the upsized relief valve device can cause significantly increased low pressure pulsations, leading to failure of the low pressure side components.

SUMMARY

The present invention solves the aforementioned drawbacks of the prior art by addition of an auxiliary pressure relief valve device in direct communication with the high pressure pumping chamber, relieving pressure into the low pressure side of the pump during the pumping event. This has the advantage of maintaining a reasonable relief pressure of the primary relief valve, close to the normal operating rail pressure. As in the prior art, this primary relief valve opens only during the charging stroke of the pump. The new auxiliary valve relieves pumping chamber pressure during the pumping stroke, thereby "averaging" the flow back to the low pressure side of the pump. This keeps the low pressure pulsations to a minimum, and alleviates the need for a very large primary relief valve. Because the auxiliary relief valve is in direct communication with the pumping chamber, it can easily be installed within the pump housing.

DETAILED DESCRIPTION

Figure 1:
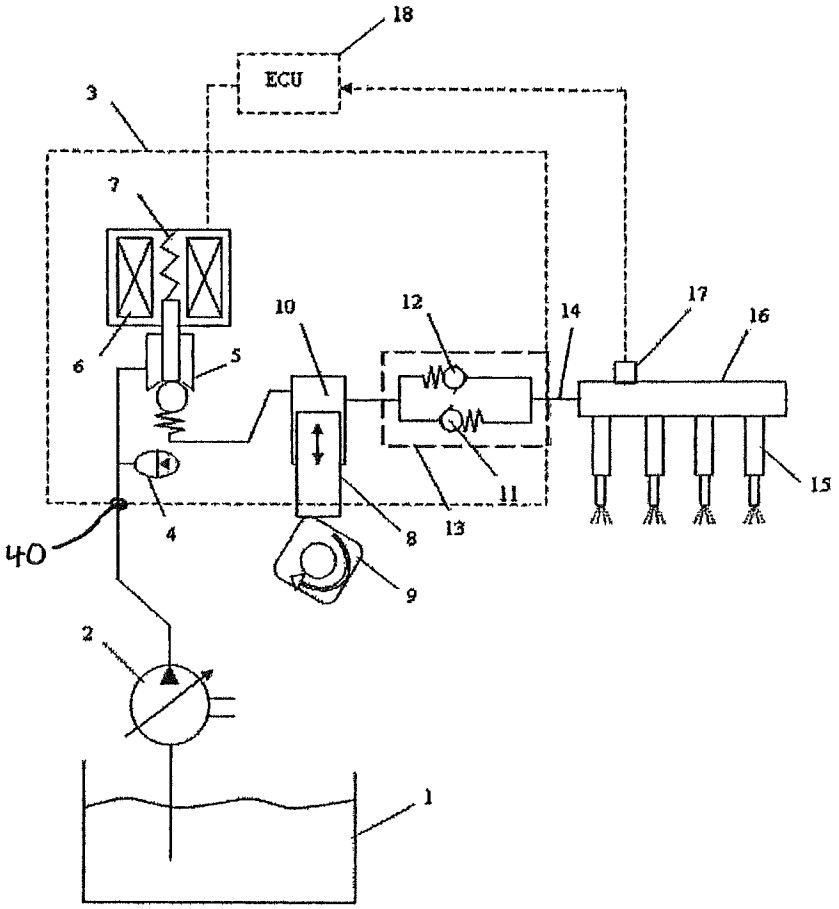
Figure 1 PRIOR ART
FIG. 1 shows a system schematic of a prior art fuel system for an internal combustion engine.

According to FIG. 1, a low-pressure pump 2 pressurizes fuel from a fuel tank 1, and delivers it to a high pressure pump through an inlet fitting 40. The fuel then passes under the influence of an accumulator 4 to a normally closed control valve 5. A normally open control valve 5 is also applicable to such a fuel system. Once the fuel passes through the control valve 5 the fuel is drawn into a pumping chamber 10, where an engine camshaft 9 drives a pumping piston or plunger 8 in an upward motion, pressurizing the fuel.

The control valve 5 is acted upon by a control valve spring 7 and a solenoid 6 to control the quantity of fuel delivered by the high pressure pump. This is accomplished by coordinating the action of the control valve 5 and the motion of the pumping piston 8, such that the control valve 5 closes when the pumping piston 8 is driven in an upward motion by the engine camshaft 9. When the fuel is thus pressurized, it travels through an outlet check valve 11, a high pressure line 14, and into a common rail 16 that feeds engine fuel injectors 15. Because the injectors 15 are fed from a common rail 16, injector timing is flexible.

Desired rail pressure is controlled by a closed feedback loop in the Electronic Control Unit (ECU) 18 including control of the high pressure fuel output via the solenoid 6 and control valve 5 compared to the rail pressure sensor 17 output signal to the ECU 18. A primary pressure relief valve 12 is required to protect the high pressure system in case of a system malfunction. The outlet check valve 11 and primary pressure relief valve 12 are preferably contained in a common fitting assembly 13, but this is not required for the present invention.

Figure 2:
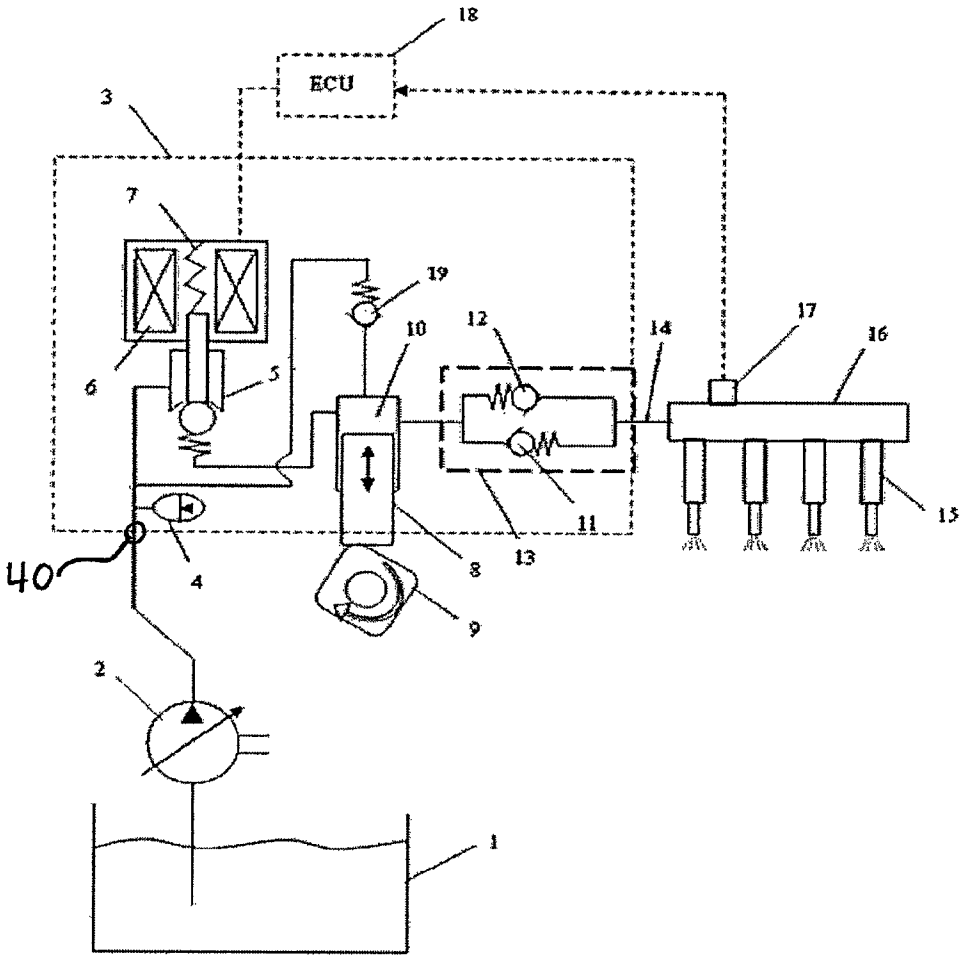
FIG. 2 shows a system schematic of a fuel system incorporating the auxiliary relief valve in accordance with the present disclosure.
Figure 5:
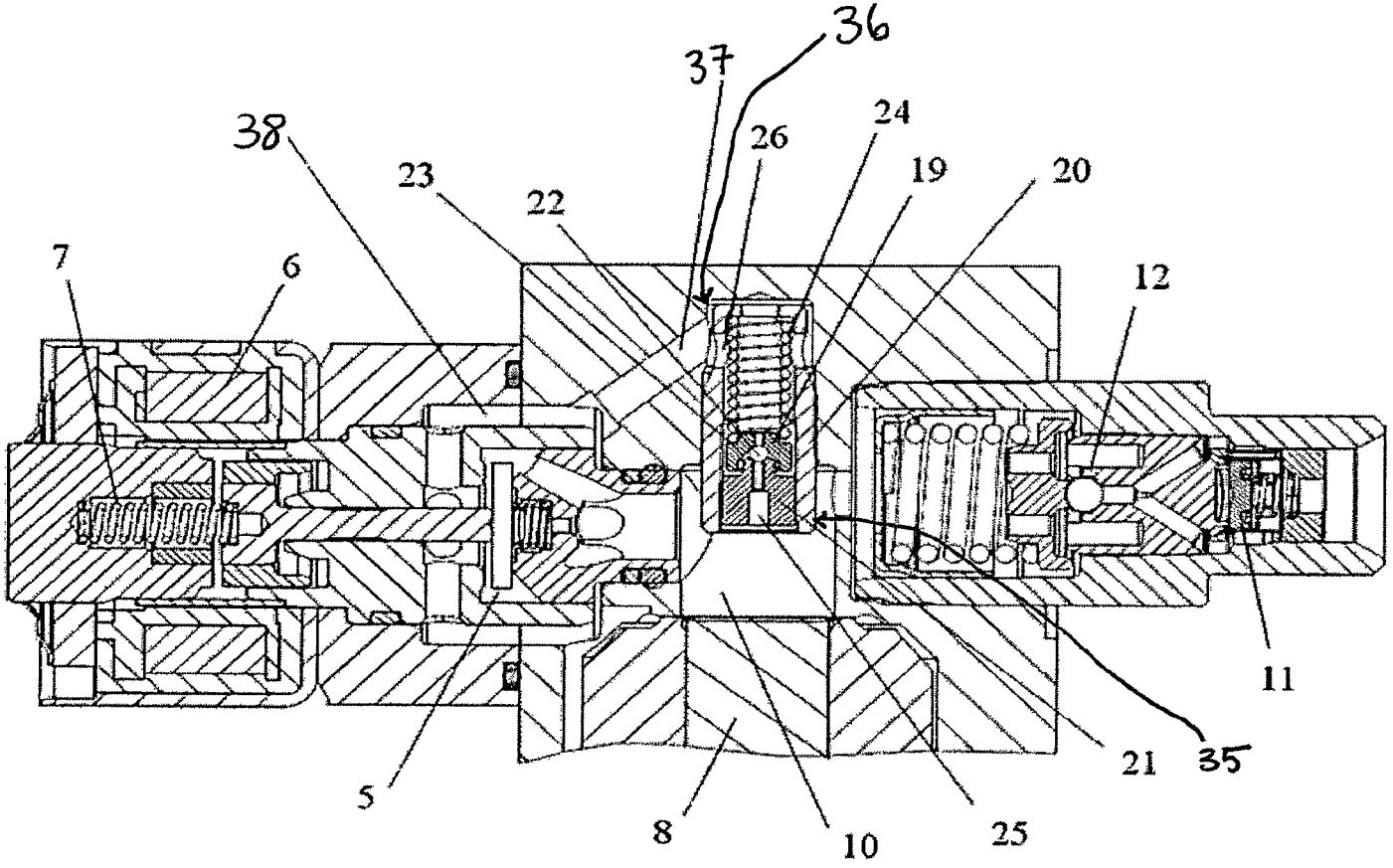
FIG. 5 shows one embodiment of the auxiliary pressure relief valve device in accordance with the present disclosure.

As shown in FIGS. 2 and 5, a fuel system in accordance with the present disclosure incorporates the features and function of the prior art fuel system of FIG. 1, and includes an auxiliary pressure relief valve 19. The auxiliary pressure relief valve 19 relieves excess pressure in the pumping chamber caused by system malfunction before the excess pressure may reach the high pressure line 14 or common rail 16. Alternately, the auxiliary relief valve 19 may be in fluid communication with the high pressure line 14 instead of the pumping chamber 10; however there are advantages to direct fluid connection to the pumping chamber 10. Firstly, the peak chamber pressure and resulting cam loading is minimized by eliminating the added pressure drop across the outlet check valve 11. Secondly, a high degree of sealing integrity is not required for the auxiliary relief valve 19 when pressure from the common rail 16 does not act on the auxiliary relief valve 19 (as depicted in FIG. 2) during normal operation such as during a hot soak.

Figure 3:
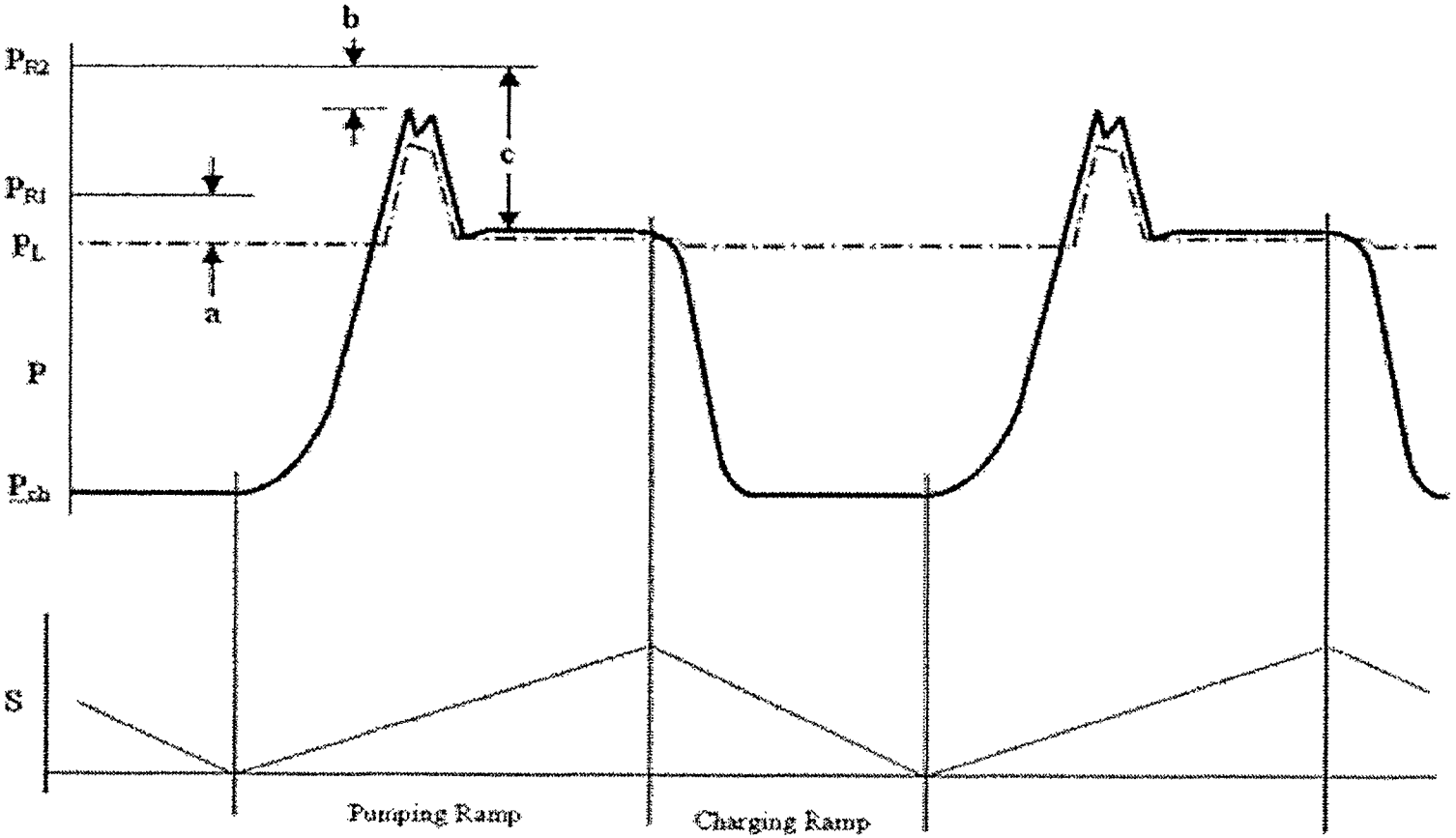
FIG. 3 shows the normal operational plunger motion and pressure profiles of the pump of the fuel system of FIG. 2.

With reference to FIG. 3, the lower portion of the graph shows the plunger lift S and pumping and charging ramps defined by the camshaft, while the upper graph shows the normally functioning pumping chamber pressure profile $P_{ch}$ (solid line) and high pressure line pressure profile $P_L$ (dashed line). The primary pressure relief valve 12 (FIG. 2) is set to open at pressure $P_{R1}$ with a margin "a", to avoid unwanted opening. The auxiliary pressure relief valve is set to open at pressure $P_{R2}$ with a margin "b" over the peak normal chamber pressure and margin "c over the stabilized pumping chamber pressure. The auxiliary relief valve 19 can operate for brief periods when the peak pumping chamber pressure exceeds $P_{R2}$ (b<0) or for extended durations, when c<0.

Figure 4:
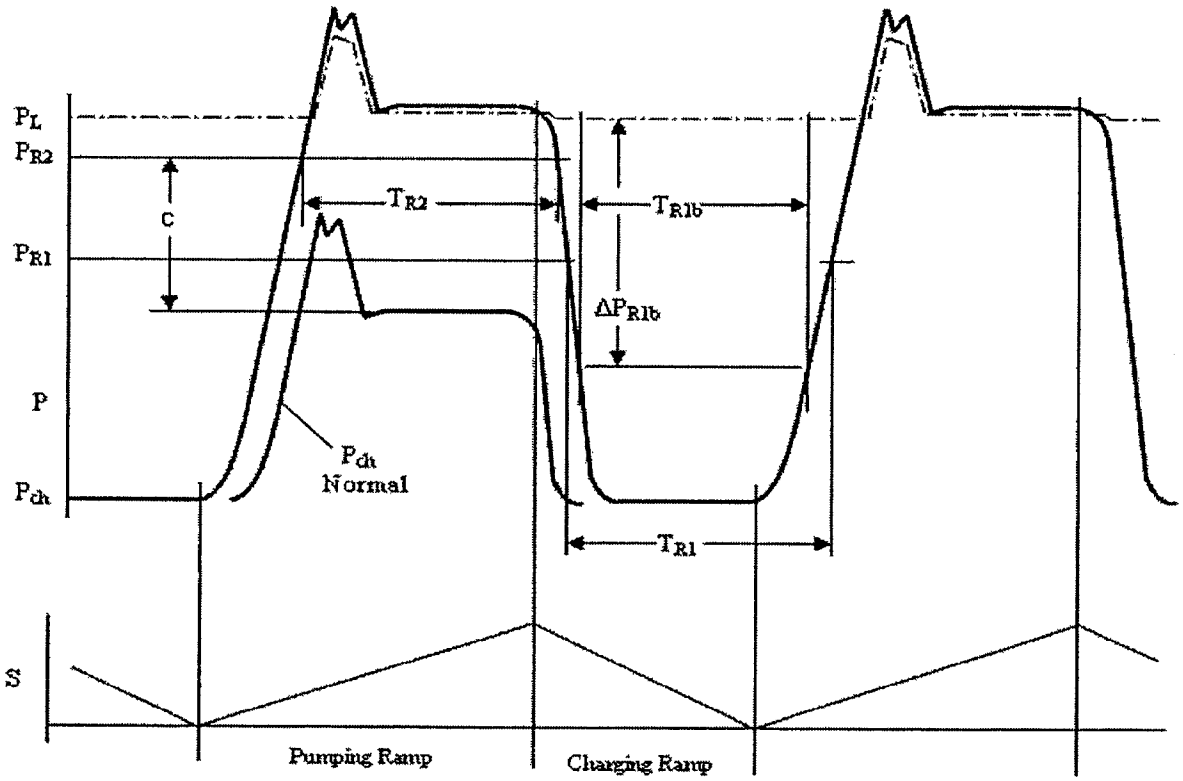
FIG. 4 shows the pressure profiles of the pump of the fuel system of FIG. 2 during a high speed system malfunction.

As shown in FIG. 4, the primary pressure relief valve 12 (FIG. 2) operates during time $T_{R1}$ when $P_L$ is at or slightly above the opening pressure $P_{R1}$. As pump speed is increased, the line pressure $P_L$ increases due to the higher pump flow rate and restricted flow through the primary pressure relief valve 12. When pump speed is increased the primary pressure relief valve also operates for less time $T_{R1b}$, which is determined by the difference between the line pressure $P_L$ and pumping chamber pressure $P_{ch}$ (designated $\Delta P_{R1b}$) when $\Delta P_{R1b}$ is greater than or equal to $P_{R1}$. The auxiliary pressure relief valve 19 (FIG. 2) operates for a maximum time $T_{R2}$ whenever the pumping chamber pressure is above the set point $P_{R2}$. $P_{ch}$ Normal is the pumping chamber pressure profile during normal pump operation as depicted in FIG. 3.

As shown in FIG. 5, the auxiliary pressure relief valve 19 comprises a cylindrical valve body 20 having an inlet side 35 in hydraulic communication with the common rail 16 downstream of the outlet check valve 11 and primary pressure relief valve 12. An outlet side 36 of the valve body 20 is in hydraulic communication with a fuel passage 37. The fuel passage 37 is in hydraulic communication with a low pressure feed annulus 38 which is in communication with the low pressure side of the pump assembly, upstream of the control valve 5.

A relief valve sealing seat 21 having a through bore 25 is configured at the inlet side 35 of the valve body 20. A ball 22, a spring seat 23 and a spring 24, are configured intermediate the sealing seat 21 and an outlet bore 26. The outlet bore 26 is at the outlet side 36 of the valve body, and configured in hydraulic communication with the fuel passage 37. In an alternate embodiment (not shown), the various components may be assembled separately into a bore in the pump housing 3 which comprises the valve body 20.

The relief valve spring 24 is placed within the valve body 20 to apply a load through the spring seat 23 and force the ball 22 sealingly against the relief valve sealing seat 21, which is press-fit into the valve body 20. The opening pressure may be adjusted by pressing the relief valve sealing seat 21 deeper into the valve body bore 20 until the spring 24 is adequately compressed. Once the relief pressure is set, the auxiliary relief valve assembly 19 is installed into the pump housing 3 by press-fitting the valve body 20 into the pump housing 3.

During auxiliary relief valve operation, fluid flows from the pumping chamber 10 and passes through bore 25 and around the ball 22. Once fluid passes around the ball 22, fluid passes around the spring seat 23 and through the bore 26. Once fluid passes through the bore 26 it can then pass into the low pressure side of the pump upstream of the control valve 5.

Figure 6:
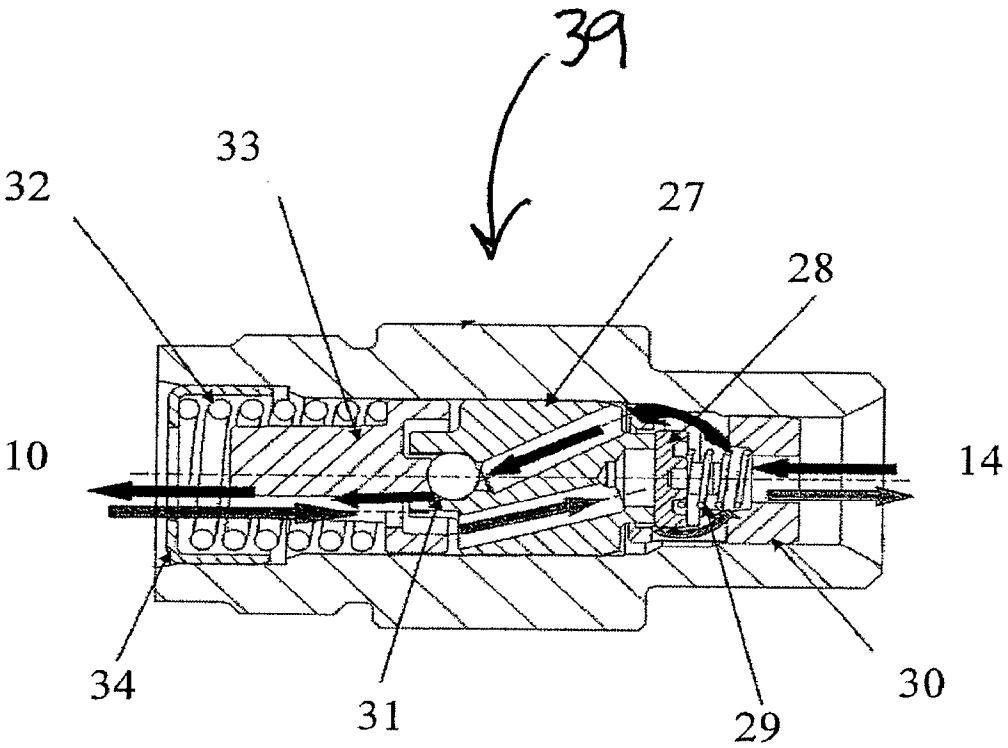
FIG. 6 shows an outlet fitting assembly for use with an alternate embodiment of the pump assembly depicted in FIGS. 2 and 5.

FIG. 6 depicts an outlet fitting assembly 39 for use with an alternate embodiment of the pump assembly. In the alternate embodiment, the outlet check valve 11 and primary pressure relief valve 12 are replaced by the outlet fitting assembly of FIG. 6. The outlet fitting assembly 39 is in hydraulic communication with the pumping chamber 10 at one end, and the high pressure line 14 at the other end. An outlet/pressure relief seat 27 is affixed and sealed to the outlet fitting 39 by an interference fit. An outlet check valve 28 is biased closed against the outlet/pressure relief seat 27 by an outlet check spring 29 and guided by an outlet check stop 30.

A pressure relief spring 32 imparts a biasing force upon spring seat 33, which biases and seals a pressure relief ball 31 against the outlet/pressure relief seat 27. Adjustment cup 34 is interference fit into the end of the fitting assembly in hydraulic communication with the pumping chamber 10, bearing against spring 32 until the desired opening pressure of ball 31 is reached.

During normal pump operation, the fuel flow follows the arrows toward the right during the pumping phase of the operational cycle. During the charging phase the outlet check valve 28 closes, preventing any backflow through the fitting into the pumping chamber 10. If the pressure in the system during the charging phase exceeds the biasing force provided by the pressure relief spring 32, the pressure relief ball 31 will be forced toward the pumping chamber 10, allowing fuel to flow in the direction of the leftward directed arrows, into the pumping chamber 10.

The invention claimed is:

1. A fuel pump having a low pressure fuel inlet and a single piston pumping chamber for supplying a metered quantity of high pressure fuel through a pump outlet and high pressure fuel line to an inlet side of a common rail, comprising: a control valve hydraulically connected to the pumping chamber for metering the quantity of fuel pumped through the pump outlet; a primary pressure relief valve having an inlet side in hydraulic communication with the inlet side of the common rail and an outlet side in fluid communication with the pumping chamber; and an auxiliary pressure relief valve having an inlet side in direct hydraulic communication with one of the pumping chamber or inlet side of the common rail and an outlet side in direct fluid communication with a fuel passage at the low pressure of the pump inlet;

wherein said fuel passage at the low pressure of the pump inlet is an infeed fuel passage, said control valve meters a flow of low pressure fuel through said infeed fuel passage from said fuel inlet to said pumping chamber during a charging stroke of the pump, and the outlet side of the auxiliary pressure relief valve is in direct hydraulic communication with said infeed fuel passage upstream of the control valve.

2. The pump of claim 1 wherein the pumping chamber has a normal pumping chamber pressure profile ($P_{ch}$) including a peak normal pressure, the auxiliary pressure relief valve has a static opening pressure ($P_{R2}$) that is higher than said peak normal pressure, and the primary pressure relief valve has a static opening pressure ($P_{R1}$) that is lower than the static opening pressure ($P_{R2}$) of the auxiliary pressure relief valve.

3. The pump of claim 1 wherein the primary pressure relief valve is located in a fitting attached to the pump housing at the pump outlet and the auxiliary pressure relief valve is located entirely within the pump housing.

4. The pump of claim 3, wherein an outlet check valve in hydraulic communication with a high pressure fuel line is also located in the fitting.

5. The pump of claim 3, wherein an outlet check valve in hydraulic communication with a high pressure fuel line is contained in a separate fitting from the primary pressure relief valve, and both the outlet check valve and primary pressure relief valve are in hydraulic communication with a high pressure fuel line.

6. The pump of claim 1 wherein both the primary pressure relief valve and the auxiliary pressure relief valve are located within the pump housing.

7. The pump of claim 1, wherein said control valve is operatively connected to an electronic control unit that controls high pressure fuel output, the electronic control unit is configured to open or close the control valve via a solenoid, upon receiving an output signal from a rail pressure sensor in hydraulic communication with the common rail.

8. The pump of claim 1, wherein the auxiliary pressure relief valve is located entirely within the pump housing with the inlet side of the auxiliary relief valve in direct fluid communication with said pumping chamber; and the primary pressure relief valve static opening pressure ($P_{R1}$) is lower than the auxiliary pressure relief valve static opening pressure ($P_{R2}$).

9. The pump of claim 1, wherein the pump includes an outlet fitting having an outlet check spring at a first end biasing an outlet check valve closed against an outlet/pressure relief seat interference fit within the outlet fitting, the outlet check spring abutting an outlet check stop at an end axially opposite the outlet check valve, and a pressure relief spring at a second end of the outlet fitting biasing a spring seat and pressure relief ball against the outlet/pressure relief seat, the pressure relief spring abutting an adjustment cup at an end axially opposite the spring seat and pressure relief ball; and the first end of the outlet fitting is in hydraulic communication with the high pressure fuel line, and the second end of the outlet fitting is in hydraulic communication with the pumping chamber.

10. The pump of claim 1, wherein the primary pressure relief valve has a static opening pressure ($P_{R1}$) that is lower than a static opening pressure ($P_{R2}$) of the auxiliary pressure relief valve.

11. The fuel pump of claim 1, wherein the auxiliary pressure relief valve has an inlet side in hydraulic communication with the inlet side of the common rail.

12. The pump of claim 11, wherein the primary pressure relief valve is located in a fitting attached to the pump housing at the pump outlet and the auxiliary pressure relief valve is located entirely within the pump housing with the inlet side of the auxiliary valve in direct fluid communication with said high pressure fuel line in hydraulic communication with the inlet side of the common rail.

13. The pump of claim 12, wherein an outlet check valve in hydraulic communication with said high pressure fuel line is also located in the fitting.

14. The pump of claim 12, wherein an outlet check valve in hydraulic communication with said high pressure fuel line is contained in a separate fitting from the primary pressure relief valve, and both the outlet check valve and primary pressure relief valve are in hydraulic communication with said high pressure fuel line.

* * * * *